US005752782A

United States Patent [19]

Hulicsko

[11] Patent Number: 5,752,782

[45] Date of Patent: May 19, 1998

[54] MOBILE SELF-PROPELLED POTHOLE PATCHING MACHINE

[76] Inventor: Leslie Hulicsko, 1891 Albert Street N., Regina, Saskatchewan, Canada, S4P 3H1

[21] Appl. No.: 573,233

[22] Filed: Dec. 15, 1995

[51] Int. Cl.[6] ..... E01C 19/26; E01C 19/48

[52] U.S. Cl. ..... 404/103; 404/107; 404/108; 404/129

[58] Field of Search ..... 404/72, 84.1, 85, 404/103, 107, 108, 129; 222/412, 413; 401/208, 218, 219, 220; 49/246, 248

[56] References Cited

U.S. PATENT DOCUMENTS

| | | | |
|---|---|---|---|
| 3,625,120 | 12/1971 | Nagy | 404/107 |
| 4,440,701 | 4/1984 | Ohki et al. | 264/15 |
| 5,131,788 | 7/1992 | Hulicsko | 404/108 |
| 5,222,828 | 6/1993 | Magalski | 404/103 |

FOREIGN PATENT DOCUMENTS

| | | | |
|---|---|---|---|
| 824780 | 12/1959 | United Kingdom | 49/248 |

*Primary Examiner*—Tamara L. Graysay
*Assistant Examiner*—Gary S. Hartmann
*Attorney, Agent, or Firm*—Adrian D. Battison; Murray E. Thrift

[57] ABSTRACT

A mobile pothole patching machine comprises a vehicle frame which carries a hopper for receiving a filler material for the pothole. Underneath the vehicle is mounted a belt conveyor which can be moved back and forth longitudinally of the vehicle and can be pivoted side to side about a vertical axis. At a front of the conveyor is mounted a laying apparatus including a roller and a rake. The rake can be raised relative to the roller and both can be raised relative to the ground by a lifting apparatus attached to the conveyor. A fabric wiper carries an anti-sticking agent draped over the top of the roller. A blow heater is mounted on the laying apparatus and has a pipe directing heated air into the potholes. In front of the rake is mounted an air jet and a bonding agent jet for cleaning and bonding the pothole. The hopper includes a pair of cover plates which can be pivoted out to the sides on two links. The material from the hopper is conveyed by an auger flight with a canopy over the auger flight which can be moved longitudinally to support the weight of the filler material when the hopper is filled and to release the filler material to the auger flight.

23 Claims, 7 Drawing Sheets

MOBILE SELF-PROPELLED POTHOLE PATCHING MACHINE

BACKGROUND OF THE INVENTION

This invention relates to a mobile, self-propelled pothole patching machine and to a number of improvements which allow the pothole patching machine to operate more effectively.

One such pothole patching machine is shown in prior U.S. Pat. No. 5,131,788 issued Jul. 21, 1992 of the present inventor. That machine comprises a vehicle frame having ground wheels by which the vehicle can be moved from place to place for operating upon potholes wherever they occur. On the vehicle frame is mounted a hopper for carrying a filler material. At the bottom of the hopper is provided a conveyor which carries the material forwardly from the hopper on a horizontal conveyor which projects outwardly beyond the forward end of the vehicle. The conveyor can pivot about a vertical axis so as to move a forward end of the conveyor horizontally across the front of the vehicle. In addition the conveyor can be moved so that the forward end moves forwardly and rearwardly. A tamping device is carried by the conveyor underneath the front end of the conveyor so that material discharged by the conveyor into a pothole can be tamped by vertical movement of the tamping device. A heater is provided to maintain the tamping device at the heated temperature to apply heat to the filler material. A jet is provided at the front of the tamping device for a bonding agent to be injected into the pothole before the filler material is applied.

This device has achieved some commercial success but has a number of problem areas which require attention.

Firstly the tamping device does not provide a sufficiently flattened and level surface of the filler material which is acceptable for many road surfaces.

Rollers are of course known for flattening such filler material but there is a significant problem with rollers that they tend to lift and carry the filler material. In addition the roller by itself is insufficient to provide a leveling effect.

Furthermore it is required to provide a larger hopper with an increased capacity for the filler material and this has provided a number of difficulties in the design of the hopper including the construction of the covers and the movement of the filler material from the base of the hopper in the auger flight which forms part of the conveyor.

SUMMARY OF THE INVENTION

It is one object of the present invention, therefore, to provide an improved mobile pothole patcher of this type including a roller and rake assembly for operating upon the filler material, an improved heating arrangement for heating an area around the rake, an improved system for maintaining the roller clear of adhered filler material, an improved discharge auger arrangement for the hopper and an improved cover arrangement for the hopper.

According to one aspect of the invention there is provided a mobile, self-propelled pothole patching machine comprising: a vehicle frame; ground wheels for transportation of the vehicle frame across the ground to a pothole to be patched; a hopper mounted on the frame for transporting a filler material for use in the patching; a conveyor mounted on the vehicle frame for receiving the filler material from the hopper and for transporting the material to the pothole; and apparatus for laying the material in the pothole comprising: a roller; a rake; means mounting the roller and the rake on the vehicle frame for transitional movement relative thereto in a horizontal plane to effect raking and rolling of the material; first lifting means for lifting the roller; and second lifting means for lifting the rake relative to the roller.

According to a second aspect of the invention there is provided a mobile, self-propelled pothole patching machine comprising: a vehicle frame; ground wheels for transportation of the vehicle frame across the ground to a pothole to be patched; a hopper mounted on the frame for transporting a filler material for use in the patching; a conveyor mounted on the vehicle frame for receiving the filler material from the hopper and for transporting the material to the pothole; and apparatus for laying the material in the pothole including a roller for rolling the filler material including means for applying an anti-sticking agent to the roller to prevent bonding of the filler material to the roller.

Preferably the anti-sticking agent is glycol and the applying means comprises a fabric member engaged over an upper part of the roller for wiping the anti-stick agent onto the roller and means for feeding the anti-stick agent onto the fabric member in a liquid form.

According to a third aspect of the invention there is provided a mobile, self-propelled pothole patching machine comprising: a vehicle frame; ground wheels for transportation of the vehicle frame across the ground to a pothole to be patched; a hopper mounted on the frame for transporting a filler material for use in the patching; a conveyor mounted on the vehicle frame for receiving the filler material from the hopper and for transporting the material to the pothole; and apparatus for laying the material in the pothole; wherein the hopper includes an elongate base with side walls converging to the base and wherein the conveyor includes an auger flight mounted along the base for rotation about a horizontal axis longitudinal of the base, an opening at one end of the base through which the auger flight extends for transporting the material from the base through the opening, and a canopy mounted in the hopper adjacent the base over the auger flight and means for moving the canopy longitudinally of the base from a first position covering at least a part of the auger flight to a retracted second position exposing substantially the whole of the auger flight to the filler material in the hopper.

According to a fourth aspect of the invention there is provided a mobile, self propelled pothole patching machine comprising: a vehicle frame; ground wheels for transportation of the vehicle frame across the ground to a pothole to be patched; a hopper mounted on the frame for transporting a filler material for use in the patching; a conveyor mounted on the vehicle frame for receiving the filler material from the hopper and for transporting the material to the pothole; and apparatus for laying the material in the pothole; wherein the hopper has a pair of upper doors covering an open upper edge of the hopper, the doors each comprising a horizontal panel which covers one half of the open upper edge in a closed position of the doors, each -door panel being mounted on two pairs of levers for movement from the closed position to an open position to a respective side of the hopper, each pair of levers being arranged at a respective end of the hopper and each pair including two levers each extending from an upper end at a pivot point on the door panel downwardly and outwardly toward the respective side to a lower end pivotally mounted on the hopper at the end of the hopper so that the door panels move generally horizontally across the open top edge from the closed position to the open position.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
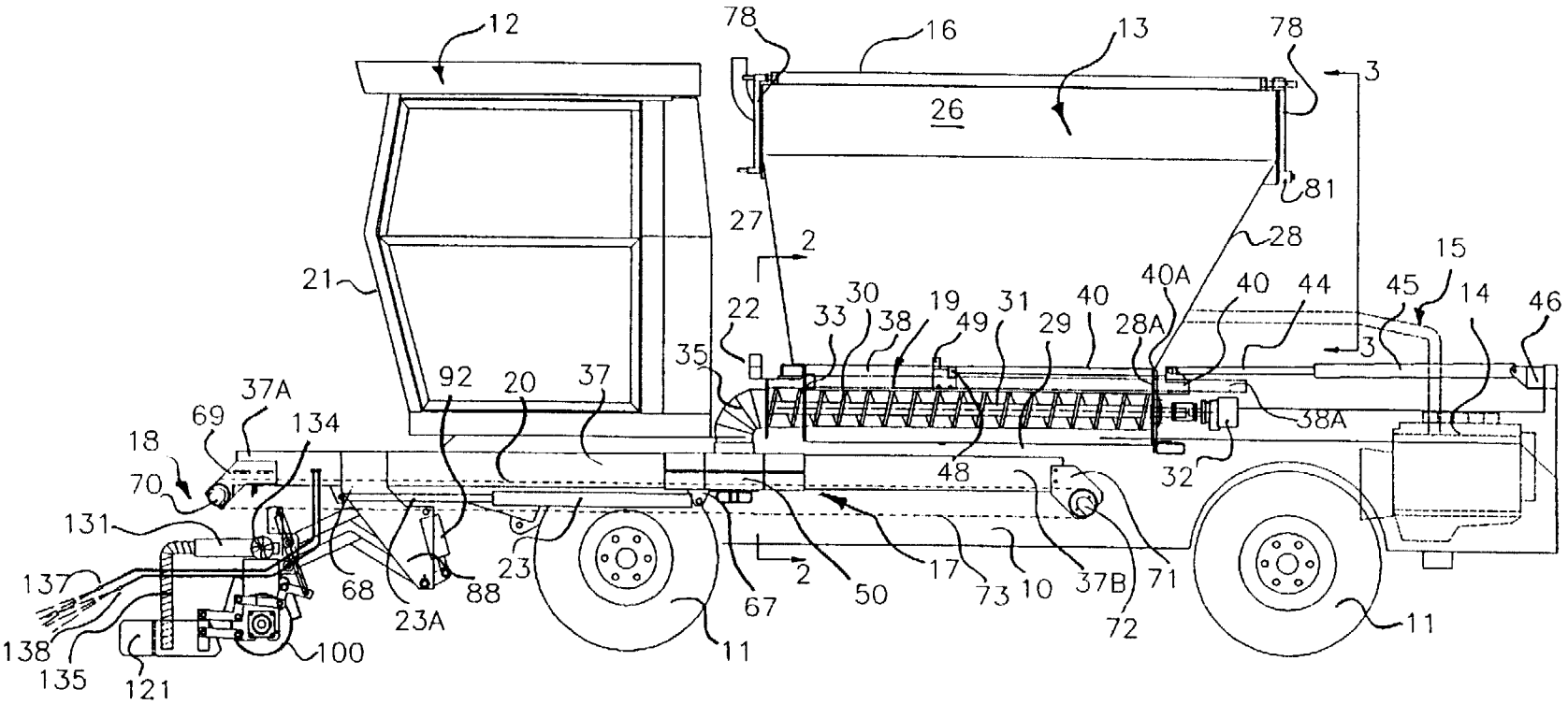
FIG. 1 is a vertical side elevational view of the mobile pothole patcher according to the present invention showing some aspects of the pothole patcher in cross section.

The apparatus comprises a vehicle frame 10 having a plurality of ground wheels 11 by which the vehicle frame can be moved from place to place across the ground to locations where the pothole requires to be patched. The vehicle frame carries a cab 12 and a hopper 13 for a filler material. The frame carries a rear mounted engine 14 which acts to drive the ground wheels to move the frame from place to place and provides hydraulic supply lines 15 supplying hydraulic fluid under pressure for driving a number of hydraulic motors on the vehicle for actuating the elements described hereinafter.

The hopper 13 includes upper doors 16 which can be open and closed to allow filling of the hopper and to cover the filler material contained within the hopper.

The machine further incudes a conveyor system generally indicated at 17 for conveying the filler material from the base of the hopper 13 to a laying apparatus generally indicated at 18 at a forward end of the vehicle. The conveyor includes an auger system 19 horizontally along the base of the hopper 13 which discharges onto a belt conveyor 20 which extends from the front of the auger system forwardly beyond the front end 21 of the cab 12 to the laying apparatus 18 which is positioned forwardly of the cab so that it can be viewed by the operator in the cab. The belt conveyor can rotate about a vertical axis 22 of the vehicle allowing the forward end and the laying apparatus to move transversely across the front of the vehicle to accommodate the location of the pothole without the necessity for movement of the vehicle. In addition the belt conveyor section 20 of the conveyor can be moved forwardly and rearwardly by a cylinder 23 so as to move the forward end of the conveyor and the laying apparatus forwardly and rearwardly relative to the vehicle again to accommodate the location of the pothole and also to effect the laying of the filler material by operation of the laying apparatus.

Figure 2:
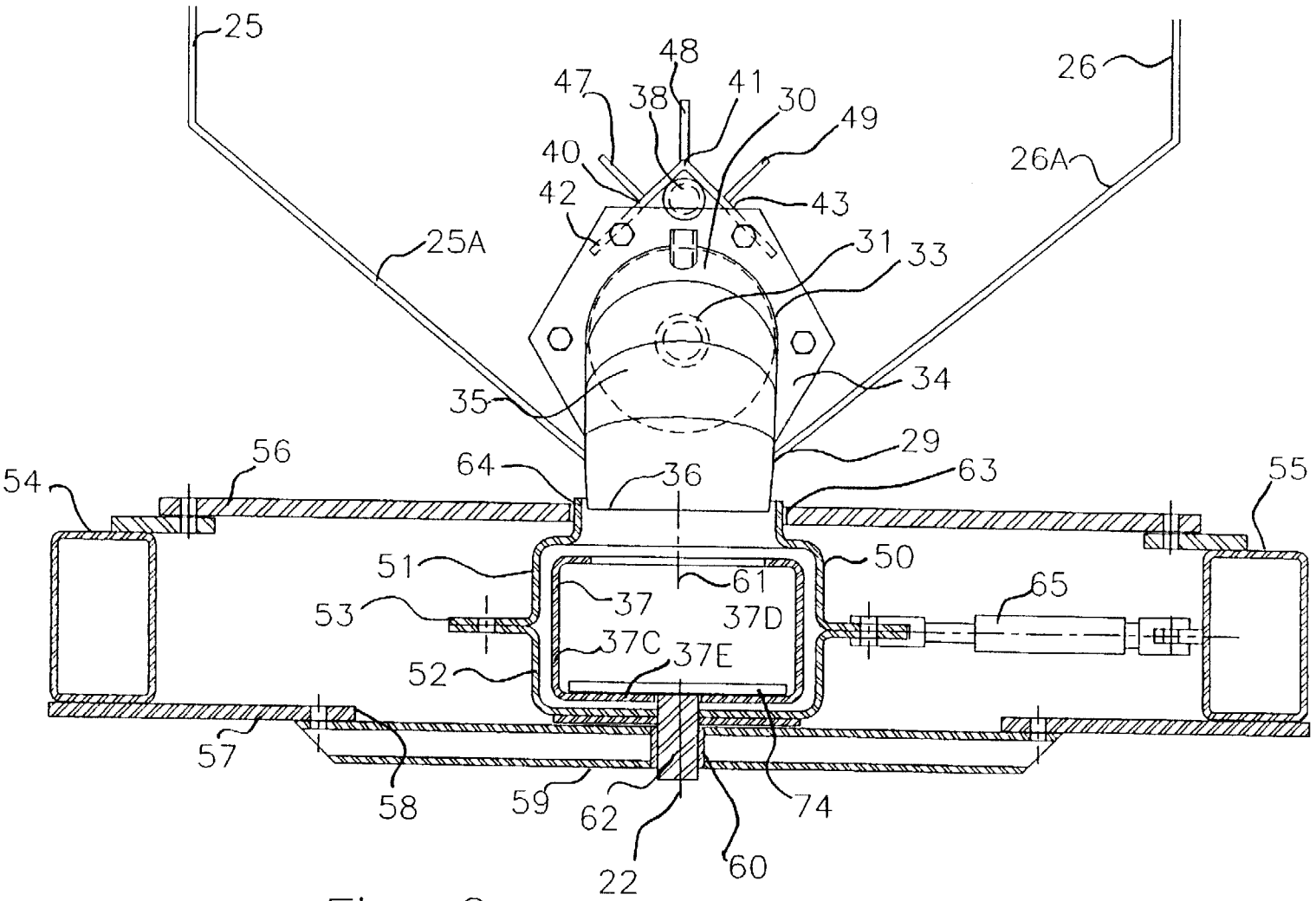
FIG. 2 is a cross sectional view along the lines 2—2 of FIG. 1 with the end wall of the hopper removed.

Turning now to FIGS. 1 and 2, the construction of the hopper and the auger section 19 are shown and will be described hereinafter. The hopper thus comprises a pair of side walls 25 and 26 together with end walls 27 and 28. The end wall 28 is inclined downwardly and forwardly whereas the end wall 27 is more vertical with only a slight inclination. The side walls 25 and 26 include lower portions 25A and 26A which are inclined sharply inwardly and downwardly to form a hopper bottom to the hopper which converges the material contained within the hopper toward a base 29 which extends along the length of the hopper and is therefore elongate extending from the forward end wall 27 to the rear end wall 28. Within the base 29 is mounted an auger flight 30 carried on a shaft 31 driven by a hydraulic motor 32 for rotation around a longitudinal axis of the shaft so that rotation of the flight tends to drive the filler material from the base of the hopper forwardly to an opening 33 in the front end wall 27.

At the opening 33 and the end wall 27 is provided a collar 34 defining a rear end of an elbow 35 which receives the material expelled by the auger flight through the opening 33 and turns that material so that it is fed forwardly and downwardly through an open bottom mouth 36 of the elbow into a conveyor housing 37.

A support beam 38 extends horizontally and centrally through the hopper at a position just above the top of the flight. The beam 38 is welded to the front wall 27 at a position just above the opening 33. The beam 38 is also welded to the rear wall 28 at a lower vertical portion 28A of the rear wall and extends through the rear wall to an extension portion 38A of the beam which projects outwardly to the rear of the hopper. The beam 38 supports a canopy 40 which is in the shape of an inverted V with an apex 41 facing upwardly and two inclined side walls 42 and 43 inclined downwardly from the apex to each side of the support beam 38. The canopy passes through a V-shape slot in the portion 28A of the rear wall 28 so that it projects outwardly to the rear of the hopper at which point it is connected to a rod 44 of a cylinder 45 for driving forward and rearward movement of the canopy. A rear end of the cylinder 45 is mounted on a support member 46 connected to the frame of the vehicle at the rear end.

The canopy thus forms a simple angled plate of V-shape across the base of the hopper and the canopy can be moved from a forward position covering a majority of the auger flight to a rearward or retracted position in which substantially the whole of the auger flight is exposed in which the forward end of the canopy is at a dotted line indicated at 40A. On top of the canopy is mounted a plurality of fins or rods 47, 48 and 49 with the rod 48 attached to the apex and extending vertically upwardly therefrom and the two side rods extending outwardly at right angles from the respective leg 42, 43. These rods are positioned adjacent the forward end of the canopy.

In operation of the canopy, when the hopper is wholly or mostly filled, the canopy is moved to the forward most position covering the majority of the auger flight. The canopy thus acts to support the filler material so that its weight does not rest wholly upon the auger flight but only upon that part of the auger flight which is exposed forwardly of the forward end of the canopy. The filler material is thus fed from this portion which is exposed to the auger flight into the auger flight and is carried by the auger flight through the opening 33 into the conveyor housing 37. As the amount of filler material in the hopper decreases, the canopy can be retracted by the cylinder 45 so as to expose more of the flight to the filler material, eventually leading to discharge of all the filler material from the hopper. The fins 47, 48 and 49 engage the filler material as the canopy is retracted so as to prevent bridging of the filler material from the rear of the hopper forwardly to the front of the canopy.

The conveyor housing 37 is mounted within a tubular receptacle 50 formed of an upper part 51 and a lower part 52 connected together by bolted flanges 53.

The frame of the vehicle includes two longitudinal frame members 54 and 55 together with a horizontal top plate 56 bolted across the top of the frame members and a horizontal bottom plate 57 similarly bolted across the bottom of the frame members. The bottom plate 57 includes an opening 58 at which is mounted a horizontal beam 59 carrying a central bearing 60 having a vertical axis 22 lying on a common axis with the central axis 61 of the mouth 36 of the elbow 35. The receptacle 50 has a post 62 mounted in the bearing 60 for rotation about the axis 22. A circular opening 63 in the top plate 56 receives the mouth 36 and the upper part 51 of the receptacle 50 has a flange 64 within the opening 63 and surrounding the mouth 36. The receptacle 50 can be rotated about the axis 22 by the action of a cylinder 65 coupled between a rear end of the receptacle 50 and an inside surface of the frame member 55. Actuation of the cylinder 65 thus pivots the receptacle 50 about the axis 22 while the mouth 36 of the elbow and the elbow itself remain fixed.

The conveyor housing 37 passes through the receptacle 50 and extends forwardly beyond the receptacle 50 to a forward end 37A and to a rearward end 37B. The housing 37 has upstanding sides 37C and 37D to where together with a horizontal base 37E. The housing 37 can be moved forwardly and rearwardly by the cylinder 23 which has a rear end 67 connected to the bottom of the receptacle 50 at a forward end thereof with a forward end of the rod 23A of the cylinder 23 connected at 68 to an underside of the horizontal base plate 37E of the housing 37. The housing 37 thus forms a structural member of sufficient strength to carry the material and also the laying apparatus 18 which is attached to the housing 37 at a forward end thereof. At the forward most end 37A of the housing there is mounted a support bracket 69 of a roller 70. At the rear end 37B is similarly mounted a bracket 71 carrying a roller 72. The rollers have parallel axis transversely to the length of the housing 37 and support a drive belt 73 which wraps around the rollers 70 and 72 and is driven by a hydraulic motor (not shown) attached to one of the rollers. The belt 73 has an upper run 74 on top of the base wall 37E of the housing 37 and a bottom or return run underneath the housing 37.

It will be clear therefore that material discharged through the mouth 36 of the elbow 35 falls through the opening defined by the flange 64 in the receptacle 50 and passes through the open top of the housing 37 onto the upper run 74 of the belt to be transported forwardly thereby to the discharge end of the belt at the roller 70.

The discharge end of the belt at the roller 70 can thus be moved forwardly and rearwardly by the cylinder 23 and can be moved from side to side by the cylinder 65. The movements are limited by the lengths of the cylinders so that the forward end moves from one side to the opposed side of the vehicle frame and moves from a retracted position in which the laying apparatus is just under the cab 12 to a forward operating position in which the laying apparatus is exposed forwardly of the cab for viewing by the operator.

Figure 3:
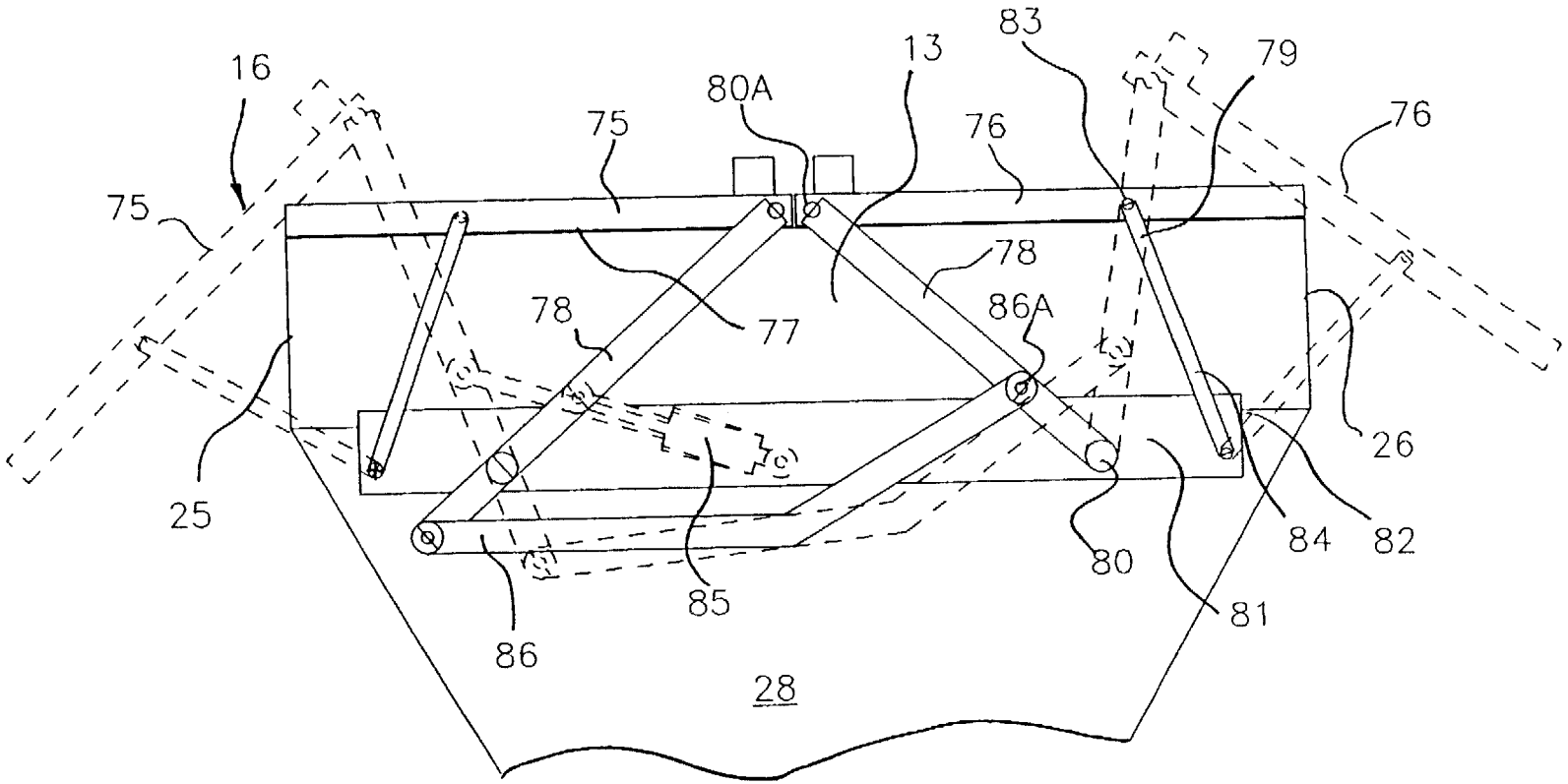
FIG. 3 is a view along the lines 3—3 of FIG. 1 showing the operation and movement of the top doors of the hopper.

Turning now to FIGS. 1 and 3, the construction and operation of the doors 16 on the top of the hopper 13 is shown. The door structure 16 thus includes two flat door panels 75 and 76 which are movable from a position covering a horizontal rectangular opening 77 of the hopper to a position shown in dotted line on each side of the hopper allowing the hopper to be filled.

Each flat door panel in the closed position lies flat on the upper open top 77. Each cover panel includes two control levers 78 and 79 which control the movement of the panel. The lever 78 has an upper end 80A pivotally connected to an innermost end of the door panel and extending therefrom downwardly and outwardly toward the respective side 25, 26 to a lower end 80 at which the lever 78 is pivotally mounted on a support plate 81 at the end wall 27, 28. The plate 81 is welded to the end wall 28 of the upper vertical portion thereof. A second lever 82 extends from an upper end 83 again pivotally connected to the door at a position part way therealong downwardly and outwardly to a lower end 84 again pivotally connected to the plate 81. The inclination of the lever 79 is less than that of the lever 78 so that the levers are not parallel. The lever 78 of one of the door panels is operated by a cylinder 85 so as to move from a closed position to a position in which the inner end of the door panel is closely adjacent the side wall 25, 26. At the same time the lever 79 carries the outer end of the door panel beyond the side wall 25, 26 so that the door panel is supported projecting outwardly from the side of the hopper. This movement prevents a high pivotal movement of any portion of the door since the door moves generally parallel to the horizontal opening 77 when it moves from a closed position toward the open position. This low profile of the doors allows the doors to be opened while the hopper is within a building or while the hopper is underneath a loading system. The levers 78 are interconnected by a control link 86 which extends from an extension of one lever upwardly to a pivot point 86A symmetrical with the connection of the cylinder 85 to the other of the levers. The control link 86 thus causes simultaneous operation of the levers 78 and therefore simultaneous movement of the door panels 75 and 76.

Turning now to the laying apparatus 18 shown in most detail in FIGS. 1, 4, 5, 6 and 7, the housing 37 carries adjacent its forward end a support bracket 88 which is welded to the sides 37C and 37D of the housing 37 and extends therefrom downwardly and rearwardly to form a structural support for the laying apparatus. The laying apparatus comprises a frame 89 which is carried on the bracket 88 by two pairs of links each including a first link 90 and a second parallel link 91. These pairs of parallel links hold the frame 89 at a predetermined position longitudinally of the housing 37 of the conveyor and actuation of the links 91 by a pair of cylinders 92 causes vertical movement of the frame 89 from a lowered operating position shown in full line in FIG. 5 to a raised transport position shown in dotted line in FIG. 5.

The links 90 and 91 are cranked to form a central apex 93 and the link 91 includes a bell crank portion 94 extending beyond the pivot mounting 95 on the bracket 88 to a pivot connection 96 with the cylinder 92. The forward end of each of the links 90 and 91 is connected to a pair of vertical brackets 97 standing upwardly at a rear of the frame 89 by pivot couplings 98 and 99.

Figure 4:
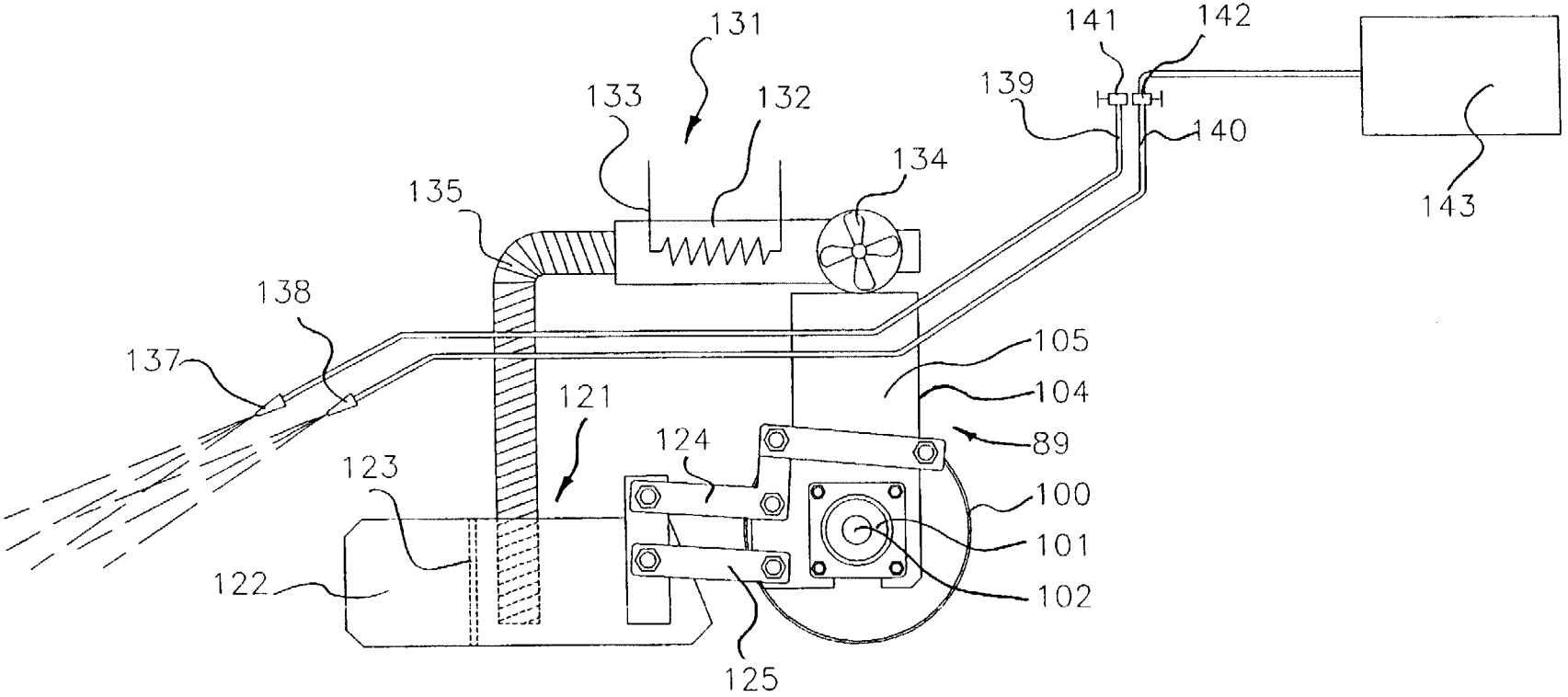
FIG. 4 is a side elevational view on an enlarged scale of the laying apparatus of FIG. 1 for laying the filler material.
Figure 5:
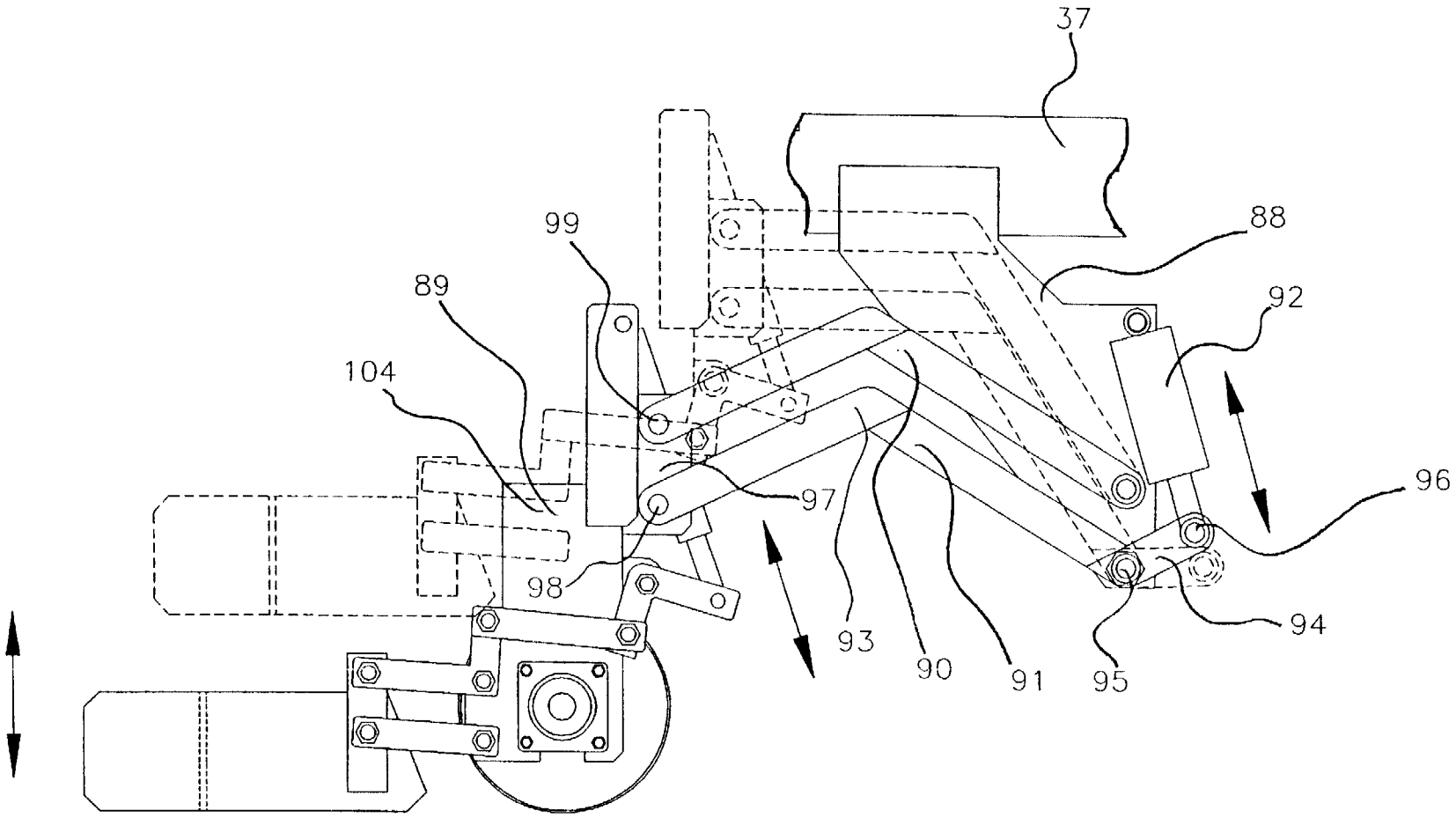
FIG. 5 is a similar side elevational view of the forward end of the conveyor and the laying apparatus showing the movement of the laying apparatus from the lowered operating position to a raised transport position.
Figure 6:
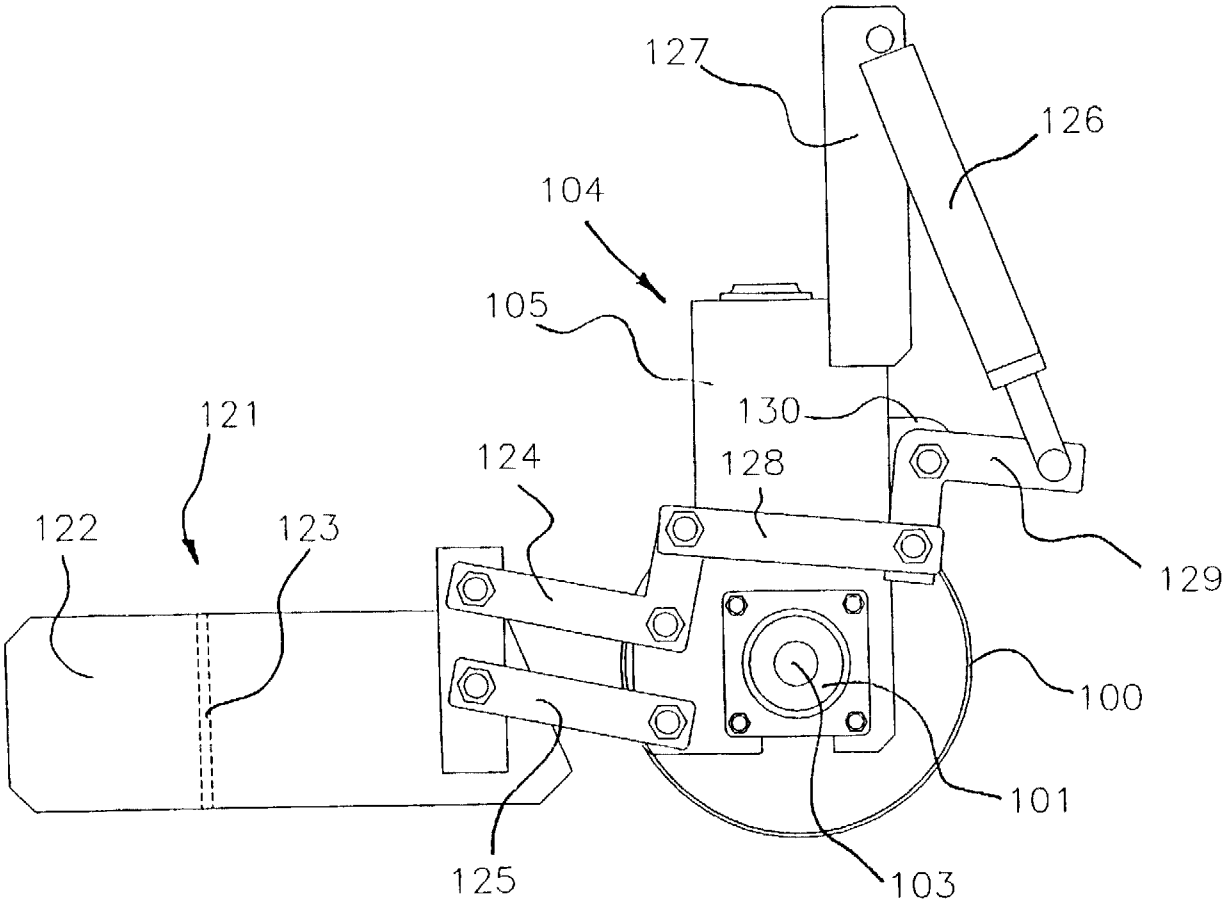
FIG. 6 is a similar side elevational view of the laying apparatus showing the rake in a raised position.
Figure 7:
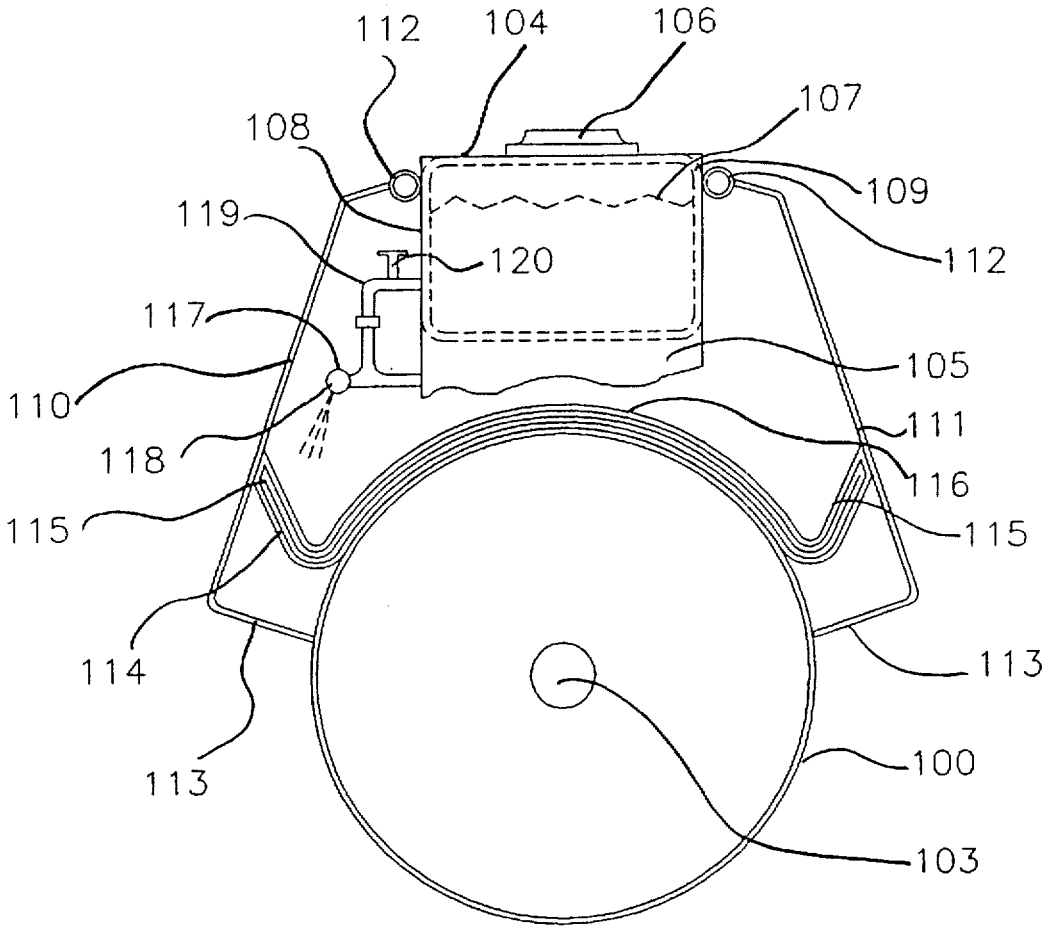
FIG. 7 is a cross sectional view through the roller of the laying apparatus showing the application-of the anti-stick agent-to the roller surface.

Turning now to FIG. 4, 6 and 7, the structure of the laying apparatus is shown in more detail with some parts of the frame structure 89 and the bracket 97 omitted in FIGS. 6 and 7 for convenience of illustration. The laying apparatus therefore comprises a roller 100 having a solid metal peripheral surface with the roller having a shaft 103 mounted on end bearings 101 for rotation about an axis 102 of the roller with that axis horizontal and at right angles to the length of the conveyor.

The frame 89 includes a rectangular tank 104 which extends across the full width of the laying apparatus. The brackets 88 are mounted at a rear vertical face of the rectangular tank 104 so the tank defines a structural member of the frame 89. At each end of the tank is mounted an end plate 105 which is vertical and parallel to the conveyor with that plate extending downwardly from the tank on either side of the roller 100 to form an end plate support for the bearing 101. The tank 104 is thus positioned directly above the roller 100 at a height a few inches above the top part of the peripheral surface of the roller 100. The tank includes a filler opening and plug 106 by which the tank can be filled with a liquid anti-sticking agent 107 which is preferably glycol.

The tank includes a front vertical wall 108 and a rear vertical wall 109. Attached to each of the front and rear vertical walls 108, 109 is provided a sheet metal cover plate 110, 111 which is pivotally mounted relative to the respective vertical wall by a hinge 112. Each cover plate extends downwardly and outwardly from the tank and includes an inturned bottom flange 113 at right angles to a main inclined wall of the cover plate with that flange turned inwardly to a position closely adjacent the surface of the roller. Each of the cover plates extends, with the tank, across the full width of the roller between the end plates 105.

A fabric wiper 114 is mounted on top of the roller and underneath the cover plates 110, 111. The wiper has ends 115 connected to the inside surface of the cover plate with those ends being just underneath the tank 104 and just above the top part of the roller 100. The fabric is relatively loose so that it falls from the ends 115 and drapes over the top surface of the roller 100 in a draped portion 116 which therefore covers the full length of the roller and a part of the periphery of the roller extending approximately over 900 of the periphery of the roller.

A spray bar 117 includes a plurality of openings 118 arranged along the length of the fabric so as to spray liquid downwardly onto the fabric across the full width of the fabric. The spray bar 117 is fed by a duct 119 from the tank 114 controlled by a valve 120 so that a selected amount of the liquid can be fed to the spray bar to be discharged onto the fabric either as a spray or simply as a drip of the liquid, preferably glycol, onto the fabric. The adjustment of the valve is so that the fabric is well moistened by the liquid across the full width of the liquid and also across the length of the liquid in view of the carrying of the liquid by the roller as it moves underneath the draped portion 116.

Preferably the fabric is a relatively thick pile fabric which can simply be a portion of carpet or the like which has the ability to carry a large quantity of the liquid and be maintained wetted with the liquid to apply the liquid onto the surface of the roller as that portion of the surfaces passes the draped portion 116.

The laying apparatus 18 further includes a rake 121 best shown in FIGS. 4 and 6. The rake includes a pair of parallel side plates 122 which are parallel to the conveyor and spaced across the width of the laying apparatus to an extent slightly greater than the length of the roller. In between the side plates 122 is attached a cross or rake plate 123 which forms simply a vertical plate having a height equal to the top of the side plates 122 and a bottom edge at the bottom of the side plates with that bottom edge being straight. The rake plate 123 is thus at right angles to the length of the conveyor so that forward and rearward movement of the conveyor moves the rake plate at right angles to its length in a raking action.

The rake 121 is mounted on each of the side plates 105 by a pair of mounting levers 124 and 125 which can move from a lowered position shown in FIG. 4 to a raised position shown in FIG. 6. This movement is obtained by operation of a cylinder 126 mounted on a vertical support bracket 127. The rake is supported by a linkage as shown at each end of the rake so that there are two such cylinders 126 and two such support brackets 127. The lever 124 forms a bell crank which is actuated by a link 128 connected to a second bell crank 129 operated by the cylinder 126 and carried on a support bracket 130 attached to the rear wall of the tank 104.

It will be appreciated therefore that operation of the cylinder 126 effects the vertical movement of the rake so that the rake can be lifted and moved forwardly over the material deposited from the conveyor and can be lowered and pulled rearwardly to rake the material rearwardly and to flatten that material into the pothole.

The laying apparatus further includes a heater generally indicated at 131 having a heater duct 132 within which is mounted a propane heater burner 133 for heating air driven by a fan 134 into a supply pipe 135. The heater and fan are mounted on top of the housing of the laying apparatus and the pipe 135 extends forwardly and then downwardly into the interior of the rake that is between the rake side plates 122 and rearwardly of the rake plate 123. The pipe 135 has a lower mouth 136 positioned just above the ground that is just above the bottom edge of the side plates when the rake is in the lowered position. More than one pipe can be provided if required to apply heat to the material across the full width of the material as it crosses the full width of the rake. The heater is intended to heat the material in the area of the rake so that it is in condition for raking and rolling.

The apparatus further includes a pair of jet nozzles 137 and 138 each of which is supplied by a respective supply pipe 139, 140 controlled by a valve 141, 142. The supply line 139 and the jet nozzle 137 are supplied by an air compressor with high pressure air for forming a jet of air for blasting any loose materials in the pothole and thus for cleaning the pothole prior to application of the filler material. The supply line 140 and the jet 138 are supplied from a tank 143 containing a bonding agent such as tack oil which is applied onto the ground in the pothole and possibly into the filler material to act as a bonding agent of the filler material to the ground.

As shown in FIG. 4, the jet nozzles 137 and 138 are arranged ahead of the rake.

In operation the pothole patcher is moved to the pothole to be patched at the location on the ground wherever that occurs. In the movement, the laying apparatus is in the raised position and the conveyor is in the retracted position so that the apparatus is transported substantially wholly underneath the front of the cab.

On reaching the pothole, the conveyor is moved forwardly by actuation of the cylinder 23 and the laying apparatus is lowered by actuation of the cylinder 92. In this position the laying apparatus can be moved from side to side by actuating the cylinder 65 and can be moved forwardly and rearwardly by actuating the cylinder 23.

With the vehicle cab rearwardly of the pothole, the laying apparatus is moved forwardly to the pothole and the air jet 137 is actuated to provide a cleaning action of the pothole to remove any loose debris. When so cleaned, the laying apparatus is moved forwardly so that the pipe 135 is positioned over the pothole and heated air is directed into the pot hole in a drying action so as to dry any moisture remaining in the pot hole.

When the drying action is complete, the laying apparatus is retracted slightly so that the jet 138 is positioned to be directed into the pothole following which the coating or bonding agent is applied through the jet 138 into the pothole.

Once the coating is complete, the laying apparatus is again moved forwardly so that the end 70 of the conveyor is positioned directly over the pothole with the end behind the rake plate 123. The material is then discharged from the hopper by actuation of the auger flight which feeds material onto the belt to be carried to the end of the belt and discharged into the pothole.

With the pothole thus filled to a height just above the surrounding surface, the rake is lowered and is pushed back and forth to provide a raking action while heat is applied to the material to soften the material thus spreading out the filler material to fill the pothole. If necessary, the rake can be raised, lifted over a pile of the material and lowered to rake material in one direction.

Once the raking is complete, the rake can be raised and the laying apparatus moved forwardly so that the roller is engaged over the filler material to apply rolling action. The application of the anti-stick agent from the tank onto the surface of the roller prevents the adhesion of the filler material and the bonding agent from occurring onto the surface of the roller.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A mobile, self propelled pothole patching machine comprising:

a vehicle frame;

ground wheels for transportation of the vehicle frame across the ground to a pothole to be patched;

a hopper mounted on the frame for transporting a filler material for use in the patching;

a conveyor mounted on the vehicle frame for receiving the filler material from the hopper and for transporting the material to the pothole;

and apparatus for laying the material in the pothole comprising:

a roller;

a rake;

means mounting the roller and the rake on the vehicle frame for transitional movement relative thereto in a horizontal plane to effect raking and rolling of the material;

first lifting means for lifting the roller;

and second lifting means for lifting the rake relative to the roller.

2. The machine according to claim 1 wherein the first lifting means is arranged to lift the rake and the roller simultaneously.

3. The machine according to claim 1 wherein the rake comprises two substantially vertical side plates and a cross plate substantially parallel to an axis of rotation of the roller.

4. The machine according to claim 1 wherein there is provided moving means for moving the conveyor in directions longitudinally of the conveyor and transversely of the vehicle frame and wherein the laying apparatus is mounted on the conveyor for movement therewith, the roller having an axis of rotation transverse to the longitudinal direction of the conveyor and the rake having a cross plate parallel to the roller axis.

5. The machine according to claim 4 wherein the first and second lifting means lift relative to the conveyor.

6. The machine according to claim 4 wherein the conveyor has a discharge end located between the roller and the rake.

7. The machine according to claim 1 wherein there is provided a first jet for directing an air stream for cleaning the pothole and a second jet for applying a bonding agent into the pothole, both of the jets being located forwardly of the rake which is mounted forwardly of the roller.

8. The machine according to claim 1 wherein there is provided an air blower and heater for heating the air and a feed duct for supplying the heated air to the area of the rake.

9. The machine according to claim 1 including means for applying an anti-sticking agent to the roller to prevent bonding of the filler material to the roller.

10. The machine according to claim 9 wherein the anti-sticking agent is glycol.

11. The machine according to claim 9 wherein the applying means comprises a fabric member engaged over an upper part of the roller for wiping the anti-stick agent onto the roller and means for feeding the anti-stick agent onto the fabric member in a liquid form.

12. The machine according to claim 11 wherein the fabric member has a width substantially equal to the roller, two ends supported above the roller and a center portion draped over the roller around a part of the periphery thereof.

13. The machine according to claim 1 wherein the hopper includes an elongate base with side walls converging to the base and wherein the conveyor includes an auger flight mounted along the base for rotation about a horizontal axis longitudinal of the base, an opening at one end of the base through which the auger flight extends for transporting the material from the base through the opening, and a canopy mounted in the hopper adjacent the base over the auger flight and means for moving the canopy longitudinally of the base from a first position covering at least a part of the auger flight to a retracted second position exposing substantially the whole of the auger flight to the filler material in the hopper.

14. The machine according to claim 13 wherein the canopy is supported on a beam extending longitudinally of the hopper above the auger flight and having a width less than that of the canopy.

15. The machine according to claim 13 wherein the canopy is substantially V-shaped in cross-section with the apex of the V-shape pointed upwardly.

16. The machine according to claim 13 including a plurality of fins on an upper surface of the canopy for engaging the filler material as the canopy is moved to prevent bridging of the filler material.

17. The machine according to claim 1 wherein the hopper has a pair of upper doors covering an open upper edge of the hopper, the doors each comprising a horizontal panel which covers one half of the open upper edge in a closed position of the doors, each door panel being mounted on two pairs of levers for movement from the closed position to an open position to a respective side of the hopper, each pair of levers being arranged at a respective end of the hopper and each pair including two levers each extending from an upper end at a pivot point on the door panel downwardly and outwardly toward the respective side to a lower end pivotally mounted on the hopper at the end of the hopper so that the door panels move generally horizontally across the open top edge from the closed position to the open position.

18. A mobile, self-propelled pot-hole patching machine comprising:

a vehicle frame;

ground wheels for transportation of the vehicle frame across the ground to a pothole to be patched;

a hopper mounted on the frame for transporting a filler material for use in the patching;

a conveyor mounted on the vehicle frame for receiving the filler material from the hopper and for transporting the material to the pothole;

apparatus for laying the material in the pothole including a roller for rolling the filler material;

and means for applying an anti-sticking agent to the roller to prevent bonding of the filler material to the roller;

the applying means comprising a fabric member engaged over an upper part of the roller for wiping the anti-stick agent onto the roller and means for feeding the anti-stick agent onto the fabric member in a liquid form:

wherein the fabric member has a width substantially equal to the roller, two ends supported above the roller and a center portion draped over the roller around a part of the periphery thereof.

19. The machine according to claim 18 wherein the anti-sticking agent is glycol.

20. A mobile, self-propelled pothole patching machine comprising:

a vehicle frame;

ground wheels for transportation of the vehicle frame across the ground to a pothole to be patched;

a hopper mounted on the frame for transporting a filler material for use in the patching;

a conveyor mounted on the vehicle frame for receiving the filler material from the hopper and for transporting the material to the pothole;

and apparatus for laying the material in the pothole;

wherein the hopper includes an elongate base with side walls converging to the base and wherein the conveyor includes an auger flight mounted along the base for rotation about a horizontal axis longitudinal of the base, an opening at one end of the base through which the auger flight extends for transporting the material from the base through the opening, and a canopy mounted in the hopper adjacent the base over the auger flight and means for moving the canopy longitudinally of the base from a first position covering at least a part of the auger flight to a retracted second position exposing substantially the whole of the auger flight to the filler material in the hopper.

21. The machine according to claim 20 wherein the canopy is supported on a beam extending longitudinally of the hopper above the auger flight and having a width less than that of the canopy.

22. The machine according to claim 20 wherein the canopy is substantially V-shaped in cross-section with the apex of the V-shape pointed upwardly.

23. The machine according to claim 20 including a plurality of fins on an upper surface of the canopy for engaging the filler material as the canopy is moved to prevent bridging of the filler material.

* * * * *